United States Patent [19]

Schneider

[11] 4,166,971

[45] Sep. 4, 1979

[54] CURRENT MIRROR ARRAYS

[75] Inventor: Herbert A. Schneider, Boulder, Colo.

[73] Assignee: Bell Telephone Laboratories, Incorporated, Murray Hill, N.J.

[21] Appl. No.: 889,292

[22] Filed: Mar. 23, 1978

[51] Int. Cl.[2] ..... G05F 3/08

[52] U.S. Cl. ..... 323/4; 330/288

[58] Field of Search ..... 323/1, 4; 330/288

[56] References Cited

U.S. PATENT DOCUMENTS

| | | | |
|---|---|---|---|
| 3,843,933 | 10/1974 | Ahmed | 323/4 X |
| 3,867,685 | 2/1975 | Ahmed | 323/4 |
| 3,936,725 | 2/1976 | Schneider | 323/1 |
| 3,952,257 | 4/1976 | Schade | 330/288 |
| 3,982,172 | 9/1976 | van de Plassche | 323/4 X |
| 3,992,676 | 11/1976 | Knight | 330/288 |
| 3,999,139 | 12/1976 | Fennell | 330/288 |
| 4,016,435 | 4/1977 | Voorman | 330/288 X |
| 4,057,763 | 11/1977 | Wheatley | 323/4 X |

FOREIGN PATENT DOCUMENTS

| | | | |
|---|---|---|---|
| 2717042 | 11/1977 | Fed. Rep. of Germany | 323/1 |

OTHER PUBLICATIONS

Radovsky, RCA Technical Note 949, Dec. 31, 1973, 7 pages, 330-288.

Barker et al., "A Precision Active Current-Splitting Circuit Technique", IEEE Journal of Solid State Circuits, Jun. 1976, pp. 406-408.

Hart et al., "The Design of Constant Current Sources", Electronic Engineering, Jun. 1977, pp. 85-88.

*Primary Examiner*—A. D. Pellinen

*Attorney, Agent, or Firm*—Charles Scott Phelan; Thomas Stafford

[57] ABSTRACT

Improved current sources which provide n output units of current responsive to m input units of current are constructed by connecting $(m+n)^2$ transistors in a square array configuration, controlled by $(m+n)$ control devices. The array contains $(m+n)$ columns each of which conducts a current the magnitude of which is desired to equal the magnitude of the current flowing in every other column, and has a maximum deviation only in proportion to $[1/(1+\beta)]^4$ where $\beta$ is the common emitter current gain of the transistors.

7 Claims, 7 Drawing Figures

FIG. 2

| CURRENTS IN FIG. 1 | $g^0$ | $g^1$ | $g^2$ | $g^3$ | $g^4$ | $g^5$ | $g^6$ |
|---|---|---|---|---|---|---|---|
| $I_1, I_2, I_3$ | 1 | | | | | | |
| $I_4, I_5, I_6$ | | 1 | | | | | |
| $I_7$ | | 3 | | | | | |
| $I_8$ | | | 3 | | | | |
| $I_9$ | | 3 | -3 | | | | |
| $I_{10}$ | 1 | -1 | | | | | |
| $I_{11}$ | 1 | -1 | 3 | | | | |
| $I_{12}$ | 1 | -1 | | | | | |
| $I_{13}$ | 1 | -1 | | | | | |
| $I_{14}$ | | 1 | -1 | | | | |
| $I_{15}$ | | 1 | -1 | | | | |
| $I_{16}$ | | 1 | -1 | 3 | | | |
| $I_{17}$ | | 3 | -3 | 3 | | | |
| $I_{18}$ | | 3 | -6 | 6 | -3 | | |
| $I_{19}$ | | | 3 | -3 | 3 | | |
| $I_{20}$ | 1 | -2 | 1 | | | | |
| $I_{21}$ | 1 | -2 | 4 | -3 | | | |
| $I_{22}$ | 1 | -2 | 1 | | | | |
| $I_{23}$ | | 1 | -2 | 1 | | | |
| $I_{24}$ | | 1 | -2 | 4 | -3 | 3 | |
| $I_{25}$ | | 1 | -2 | 4 | -3 | | |
| $I_{26}$ | | 3 | -6 | 9 | -6 | 3 | |
| $I_{27}$ | | | 3 | -6 | 9 | -6 | 3 |
| $I_{28}$ | | 3 | -9 | 15 | -15 | 9 | -3 |
| $I_{29}$ | 1 | -3 | 3 | -1 | | | |
| $I_{30}$ | 1 | -2 | 4 | -3 | 3 | | |
| $I_{C1}$ | 1 | -3 | 6 | -7 | 9 | -6 | 3 |
| $I_{01}$ | 1 | -3 | 6 | -7 | 6 | -3 | |
| $I_{02}$ | 1 | -3 | 6 | -7 | 3 | | |

NOTE: $g = \frac{1}{1+\beta}$

FIG. 4

| CURRENTS IN FIG. 3 | $g^0$ | $g^1$ | $g^2$ | $g^3$ | $g^4$ | $g^5$ | $g^6$ |
|---|---|---|---|---|---|---|---|
| $I_1, I_2, I_3$ | 1 | | | | | | |
| $I_4, I_5, I_6$ | | 1 | | | | | |
| $I_7$ | | 3 | | | | | |
| $I_8$ | | | 3/2 | | | | |
| $I_9$ | | | 3/2 | | | | |
| $I_{10}$ | | 3 | -3 | | | | |
| $I_{11}$ | 1 | -1 | | | | | |
| $I_{12}$ | 1 | -1 | 3/2 | | | | |
| $I_{13}$ | 1 | -1 | 3/2 | | | | |
| $I_{14}$ | 1 | -1 | | | | | |
| $I_{15}$ | | 1 | -1 | | | | |
| $I_{16}$ | | 1 | -1 | 3/2 | | | |
| $I_{17}$ | | 1 | -1 | 3/2 | | | |
| $I_{18}$ | | 3 | -3 | 3 | | | |
| $I_{19}$ | | | 3/2 | -3/2 | 3/2 | | |
| $I_{20}$ | | | 3/2 | -3/2 | 3/2 | | |
| $I_{21}$ | 1 | -2 | 5/2 | -3/2 | | | |
| $I_{22}$ | 1 | -2 | 4 | -3 | 3/2 | | |
| $I_{23}$ | 1 | -2 | 5/2 | -3/2 | | | |
| $I_{24}$ | 1 | -2 | 1 | | | | |
| $I_{25}$ | 1 | -2 | 5/2 | -3/2 | 3/2 | | |
| $I_{26}$ | | 3 | -6 | 6 | -3 | | |
| $I_{27}$ | | 1 | -2 | 5/2 | -3/2 | | |
| $I_{28}$ | | 1 | -2 | 4 | -3 | 3/2 | |
| $I_{29}$ | | 1 | -2 | 5/2 | -3/2 | 3/2 | |
| $I_{30}$ | | 3 | -6 | 9 | -6 | 3 | |
| $I_{31}$ | 1 | -3 | 9/2 | -4 | 3 | -3/2 | |
| $I_{32}$ | | | 3/2 | -3 | 9/2 | -3 | 3/2 |
| $I_{33}$ | | | 3/2 | -3 | 9/2 | -3 | 3/2 |
| $I_{34}$ | 1 | -3 | 9/2 | -4 | 3/2 | | |
| $I_{35}$ | | 3 | -9 | 15 | -15 | 9 | -3 |
| $I_{C1}$ | 1 | -3 | 6 | -7 | 15/2 | -9/2 | 3/2 |
| $I_{C2}$ | 1 | -3 | 6 | -7 | 6 | -3 | 3/2 |
| $I_{01}$ | 1 | -3 | 6 | -7 | 9/2 | -3/2 | |

NOTE : $g = \frac{1}{1+\beta}$

CURRENT MIRROR ARRAYS

BACKGROUND OF THE INVENTION

1. Field of the Invention

This invention relates to solid state current mirrors and more particularly to arrangements for providing a plurality of substantially equal currents from high impedance sources which are each controlled by at least one input control current.

2. Description of the Prior Art

Current sources characteristically provide a current from a very high impedance source. It is desirable that fixed current sources produce a constant output current the magnitude of which is independent of the impedance of the load which utilizes the current and variations in the voltage of the supply which energizes the current source. Such independence from voltage supply variations and load characteristics is also desirable in current sources of the type which are not fixed. The magnitude of output current from such nonfixed current sources should vary only in response to a control signal or an advantageously selectable circuit parameter such as the value of a resistance. Current mirrors are current sources the output current of which is controlled by an input current signal. Such circuits are well known and commonly used in applications where a fixed ratio is required between the relative magnitudes of the input and output currents. In an illustrative generalized current mirror arrangement the input and output currents bear a fixed relationship in the ratio n:m respectively. Thus, although varying amounts of current are drawn from a source of energizing potential, the output current will always be a fractional part m/n of the input current. This fraction may be viewed as the gain of the mirror, which gain may be less than unity in cases where the magnitude of the input current is greater than that of the output current. Current mirrors find many applications in electronic circuits, for example, they are used to supply current to various operational amplifier stages, and to convert differential stages to single-ended stages.

A first problem in the prior art to which this invention is directed relates to the precision of the fixed relationship between the magnitudes of the input and output currents in current mirrors. Assuming, for example, current mirror circuitry of the well-known Widlar type, which is further assumed to be comprised of transistor elements with matched common emitter current gains ($\beta$), input and output currents which are desired to be equal to each other will deviate in proportion to the first power of g where $g=1/(1+\beta)$. Such inequality of input and output currents is generally the result of current merging and branching at circuit nodes within the particular circuit configuration. However, the prior art has improved the precision of the correlation between the input and output currents in some current mirror arrangements. One such improved current mirror arrangement which reduces input to output current deviation to a level proportional to $g^4$ is disclosed in U.S. Pat. No. 3,936,725 which issued Feb. 3, 1976 to the above-named applicant.

The above notwithstanding, the prior art has not produced a current mirror arrangement which provides plural output or input control currents which deviate in magnitude from each other to a precision proportional to $g^4$. One multioutput current source which is illustrative of prior art arrangements and exhibits a precision of current deviation in proportion to $1/\beta$ is disclosed in U.S. Pat. No. 3,754,181.

A second problem in the prior art to which this invention is directed relates to producing an output current which bears a precise integer, but unequal, magnitude relationship to an input current. One prior art solution to the problem of achieving input to output current ratios (m:n) other than 1:1 requires the use of current mirror transistors which have unequal emitter-base junction areas. The current conducted through each transistor is proportional to its respective junction area. This technique for producing proportional current gain has the disadvantage of requiring the use of transistors having dissimilar geometries. Therefore, the current gain ratio is fixed at the time of manufacture and cannot be selectably altered thereafter.

It is, therefore, a general object of this invention to improve multioutput current sources of the type which provide output currents responsive to an input control current signal.

More specifically, it is an object of this invention to provide multioutput current mirror arrangements which exhibit improved magnitude correlation between the input and output currents over prior art current mirrors.

It is a further object to provide multioutput current sources which have higher output impedance than prior art arrangements so as to permit selectable paralleling of the output current terminals without unacceptable output impedance degradation.

SUMMARY OF THE INVENTION

The foregoing and other objects of the invention are achieved by cascoding current mirrors to produce a square array containing at least three columns of series controlled semiconductor devices. Currents flowing through the various controlled semiconductor devices from one current mirror to the next are essentially confined to flow in the respective columns of such serial controlled devices.

Each current mirror is a row of the square array and is provided with base drive means responsive to the signal at the collector of at least one controlled transistor in the mirror. Such base drive collector connections are distributed throughout the array in accordance with a connection scheme which restricts each column of serial controlled semiconductor devices to contain exactly the same number of base drive means connections as does every other column.

It is a feature of this invention that the uniform distribution of base drive means connections permits the achievement of a magnitude correlation precision between the various column currents in proportion to $g^4$.

It is another feature that since each current mirror except the first is supplied current from a preceding high impedance current mirror rather than a low impedance voltage supply as is the case in prior art arrangements, this arrangement provides improved high output impedance.

It is a further feature of this invention that the improved impedance seen looking into the array at its input and output current terminals permits m input current terminals and n output current terminals to be connected to common input and output current terminals respectively, thereby providing an overall current gain ratio of n:m with improved precision over prior art systems and high output impedance. Moreover, such precisely proportional current gain is achieved using similar transistors which are easily constructed using known integrated circuit manufacturing techniques.

It is another feature of this invention that two or more arrays are advantageously interconnected to achieve a saving in the number of semiconductor components required over a single array with the same overall gain. This is especially advantageous in arrangements where n is much greater than m so that a substantial power saving is realized by controlling large output currents with small input currents.

BRIEF DESCRIPTION OF THE DRAWING

Comprehension of the invention characterized in the claims is facilitated by reading the following detailed description with reference to the accompanying drawings, in which:

FIG. 2 is a table of coefficients of equations which describe the magnitudes of the currents flowing in the various conductors of the array shown in FIG. 1;

FIG. 4 is a table of coefficients of equations which describe the magnitudes of the currents flowing in the various conductors of the array shown in FIG. 3;

DETAILED DESCRIPTION

Figure 1:
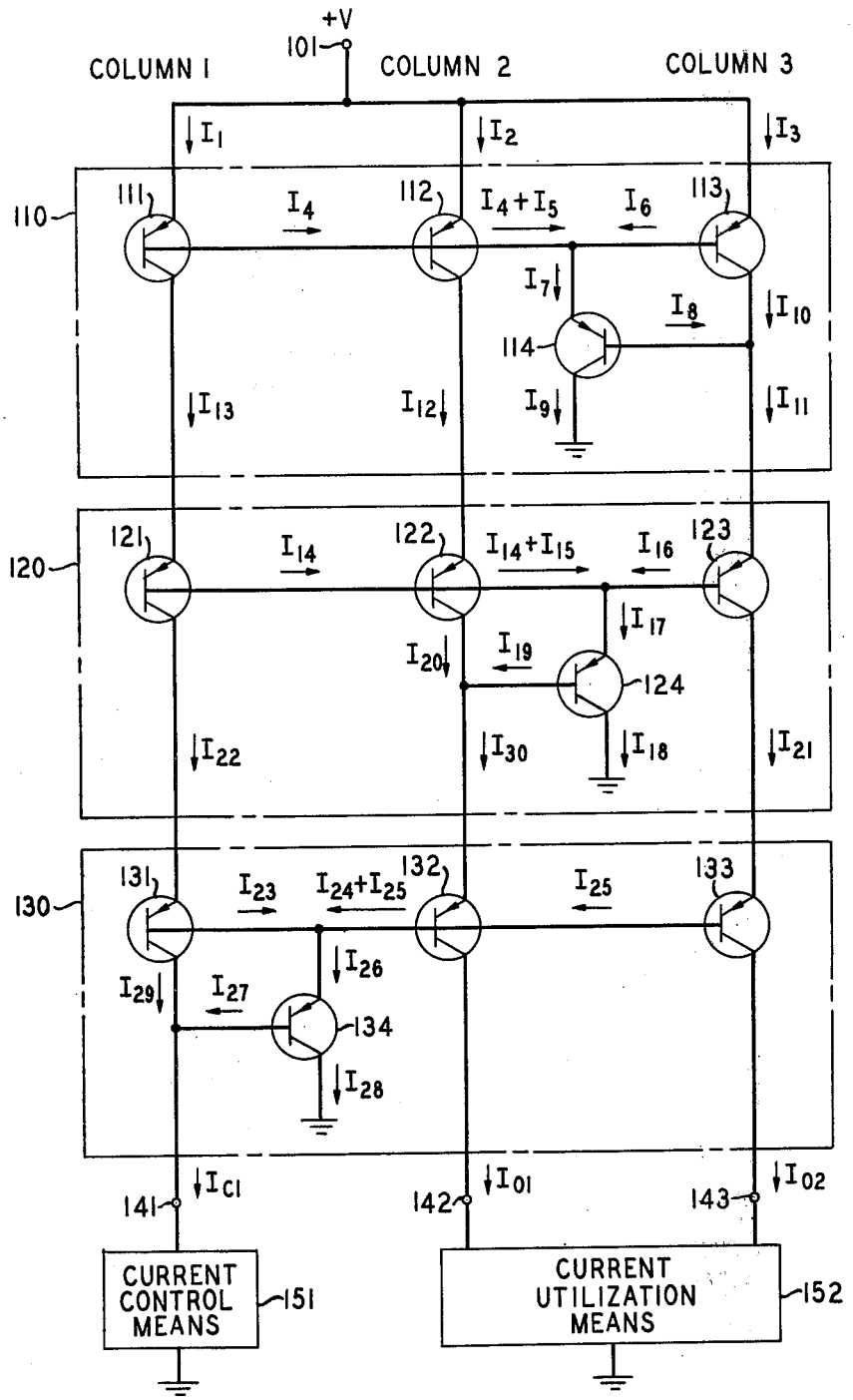
FIG. 1 shows a schematic diagram of a multiplying current mirror array in which two units of output current are controlled by one unit of input current.

A multiplying current mirror array which controls two units of output current ($n=2$) with one unit of input current ($m=1$) is schematically illustrated in FIG. 1. Current mirrors 110, 120 and 130 are each comprised of four PNP transistors, three of which are provided base drive current by the fourth transistor. Referring to current mirror 120 which is representative of the structure and operation of remaining current mirrors 110 and 130, controlled transistors 121, 122 and 123 are arranged as a row of the array and have their bases connected to each other. Each controlled transistor is supplied current at its emitter terminal from the collector of a corresponding controlled transistor in current mirror 110 and in the same column. The three controlled transistors in current mirror 120 are each provided base current control by control transistor 124 which has its emitter connected to the bases of the controlled transistors, its collector grounded and its base connected to the collector of controlled transistor 122. In the same current mirror, $I_{30}$ is the input current and $I_{21}$ and $I_{22}$ are output currents.

As indicated, current mirrors 110, 120 and 130 are functionally identical and contain corresponding elements of structure. The current mirrors are connected to each other in a cascode configuration so as to form, in this embodiment of the invention, three columns of serially connected controlled transistors. The columns are identified at the top of the circuit schematic as COLUMN 1, COLUMN 2, and COLUMN 3, and are each connected to a common terminal 101 for receiving an energizing potential.

COLUMN 1 is comprised of serial controlled transistors 111, 121 and 131 in current mirrors 110, 120 and 130 respectively. Current is conducted from a source of potential +V connected at terminal 101 through the controlled transistors and through current control means 151, which is connected between input current terminal 141 and ground. The current control means in the function block identified as 151 contains any circuitry known in the art which can control the magnitude of current $I_{c1}$. Illustratively, such circuitry may be the current control circuit for the various stages of a differential operational amplifier. COLUMN 2 and COLUMN 3 are also comprised of series controlled transistors connected to +V at terminal 101; however, the current flowing through these columns is used by any load, the characteristic limitations of which would be obvious to persons of ordinary skill in the art. Such a load, which may be the other stages of the above-mentioned differential operational amplifier, is graphically represented in FIG. 1 as CURRENT UTILIZATION MEANS 152. In some applications, it is advantageous to connect two separate current utilization means to output terminals 142 and 143, or to join nodes 142 and 143.

It is to be noted that the significant structural difference between the three current mirrors is the relative placement within each current mirror of respective base drive control transistors 114, 124 and 134. In terms of structural similarity, each of the base drive control transistors has its collector grounded and its emitter connected to the bases of the controlled transistors in the current mirror within which it is contained. Thus, the emitter of control transistor 114, is connected to the bases of controlled transistors 111, 112 and 113 in current mirror 110; the emitter of control transistor 124 is connected to the bases of controlled transistors 121, 122 and 123 in current mirror 120 and control transistor 134 is similarly connected at its emitter terminal to the bases of controlled transistors 131, 132 and 133 in current mirror 130. In addition, the base of each base drive control transistor is connected to be responsive to current variations in the collector-emitter path of one controlled transistor and thereby control the conductivity of the three controlled transistors in the associated current mirror. The significant structural dissimilarity in each current mirror is that the base of each control transistor is connected to the collector of a control transistor in a different one of the columns. In this manner, COLUMN 1, COLUMN 2 and COLUMN 3 each have the same number (i.e., one, in this embodiment) of base drive control transistor base connections. An algebraic analysis of the currents identified by the subscripted symbol "I" and which flow through the various conductor branches of this circuit in the directions indicated by the arrows is presented in connection with FIG. 2 and will reveal that the magnitudes of input and output currents $I_{c1}$, $I_{01}$ and $I_{02}$ deviate from each other in proportion to $[1/(1+\beta)]^4$, where $\beta$ is the common emitter current gain of the transistors used in the array.

FIG. 2 is a tabulation of the coefficients of the mathematical expressions which describe the various currents shown in FIG. 1. To expedite the analysis, the symbol "g" is introduced, where $g=1/(1+\beta)$. This analysis presumes that all of the transistors are matched in geometry and current gain ($\beta$) as is achieved, for example, in integrated circuitry. However, the advantages of the invention are also realized in embodiments using discrete transistors that may not be precisely matched. The first column on the left in FIG. 2 contains symbols which correspond to the subscripted symbols in FIG. 1 which identify the branch currents. Each remaining column is headed by the symbol g raised to powers from 0 to 6, (i.e., $g^0$ to $g^6$). Numbers contained in the remaining body of the table represent multipliers in the equations which define the currents identified in the first column. For example, the emitter current of transistor 132, $I_{30}1-2g+4g^2-3g^3+3g^4$.

It is assumed that the +V supply connected at voltage supply terminal 101 in FIG. 1 will supply equal unit-normalized currents to each column. These currents are identified as $I_1$, $I_2$ and $I_3$, and flow into the emitters of controlled transistors 111, 112 and 113 respectively in the first current mirror 110. These currents are noted in the first row of the table where it is indicated that currents $I_1$, $I_2$ and $I_3$ all equal 1.

It is known to persons skilled in the art that the base current, $I_b$, of a transistor equals the emitter current, $I_e$, divided by $(1+\beta)$. Thus:

$$I_b=I_e/(1+\beta)=gI_e \quad (1)$$

Current $I_4$ from the base of controlled transistor 111 is equal to $gI_1$, and since $I_1=1$, $I_4=g$. This relationship is true for the base current of each controlled transistor in current mirror 110, therefore:

$$I_4=I_5=I_6=g \quad (2)$$

and this is noted in the table of FIG. 2, where a number 1 is placed in the box in the table where the column headed $g^1$ intersects the second row. Current $I_7$ is the algebraic sum of currents $I_4$, $I_5$ and $I_6$, and therefore, the table indicates that:

$$I_7=3g \quad (3)$$

Since, as stated above, the base current of a transistor equals the emitter current multiplied by g;

$$I_8=gI_7=3g^2 \quad (4)$$

The collector current of transistor 114 is:

$$I_9=I_7-I_8=3g-3g^2 \quad (5)$$

This type of analysis is continued throughout the remainder of the array until mathematical expressions in terms of powers of g are achieved for the input and output currents, $I_{c1}$, $I_{01}$ and $I_{02}$ respectively. It can be seen from these three expressions, which are contained in the three bottom lines of the table that they each have identical multipliers for $g^0$, $g^1$, $g^2$ and $g^3$. The most significant deviation in magnitude between the input and output currents occurs at $g^4$, and the most significant deviation in magnitude between only the output currents occurs at $g^5$, in the specific illustrative embodiment of the invention. Since $\beta$ is typically greater than 20, $g^4$ is much larger than $g^5$; therefore, the magnitude deviations of the coefficients of $g^4$ are more significant than those of $g^5$, even though the coefficients of $g^5$ in the table exhibit greater percentage deviation.

Figure 3:
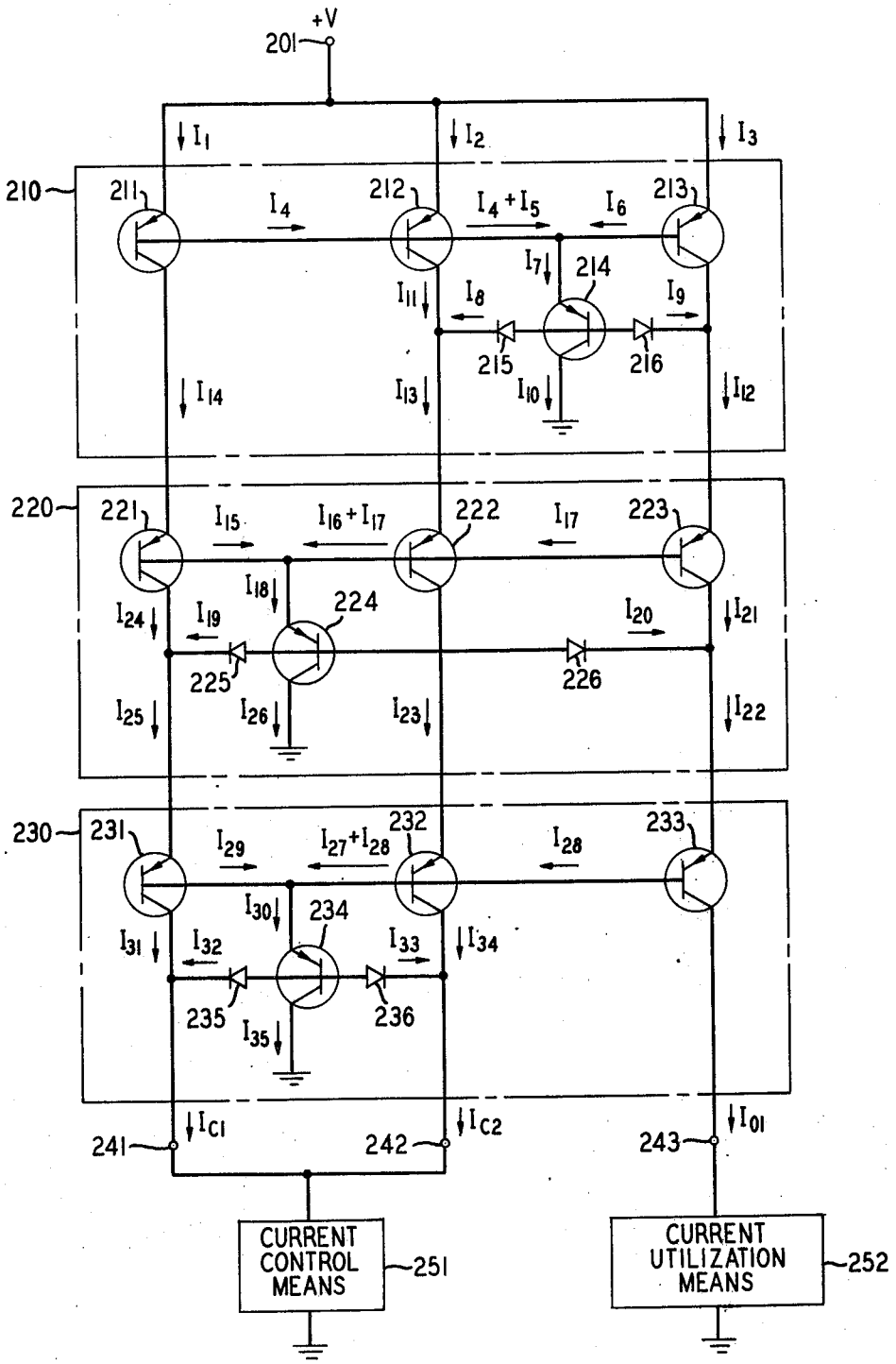
FIG. 3 shows a schematic diagram of a dividing current mirror array in which one unit of output current is controlled by two units of input current.

FIG. 3 is a schematic representation of a dividing current mirror array which controls one unit of output current with two units of input current. Current mirrors 210, 220 and 230 are similar to the current mirrors discussed in connection with FIG. 1, except that in this embodiment the base drive control means in each current mirror is connected to the collector terminals of two controlled PNP transistors. Each base drive control means is comprised of a transistor, the base connections of which are distributed differently in each current mirror so that each column contains as many base connections as does each current mirror.

The base drive control transistors are connected to the collectors of the controlled transistors by means of diodes 215, 216, 225, 226, 235 and 236 which are poled for forward current conduction in the same direction as the emitter-base junction of the associated control transistor. These diodes are included in this embodiment of the invention to prevent the collector and emitter currents flowing through the various columns of controlled transistors from combining and redistributing themselves throughout the array in other than the prescribed or desired manner. In this way, it is assured that the currents are essentially confined to their respective columns, except, of course, for currents which escape the columns by flowing through the bases of the controlled transistors. Such current confinement also aids in maintaining high impedance at the controlled transistor collectors.

Input control currents $I_{c1}$ and $I_{c2}$ are combined in this embodiment by connecting their respective terminals 241 and 242 together and to a function block identified as CURRENT CONTROL MEANS 251. As is the case with function block 151 of FIG. 1, block 251 of FIG. 3 contains circuitry known in the art for varying the combined control currents. Magnitude variations in the two combined units of input control current cause variations in the magnitude of output current $I_{01}$. CURRENT UTILIZATION MEANS 252 is representative of any known circuitry which employs such a controlled current.

The table of FIG. 4 contains the multipliers of the symbol g raised to the powers 0 to 6 in the mathematical expressions which describe the magnitudes of the currents identified by the subscripted symbol "I" in FIG. 3. The analysis recorded in FIG. 4 is similar to that in FIG. 2. Currents $I_1$, $I_2$ and $I_3$ in FIG. 3 are assumed to be equal units of current and are so recorded in the first line of FIG. 4. Analysis of the currents proceeds as described in connection with FIGS. 1 and 2, until mathematical expressions in terms of g are produced for the currents $I_{c1}$, $I_{c2}$ and $I_{01}$. These expressions are recorded on the bottom three lines of the table and it can be seen that the multipliers are equal for g raised to the powers 0 to 3. The most significant current magnitude deviations for this array, as is the case for the array of FIG. 1, are in proportion to $g^4$.

Figure 5:
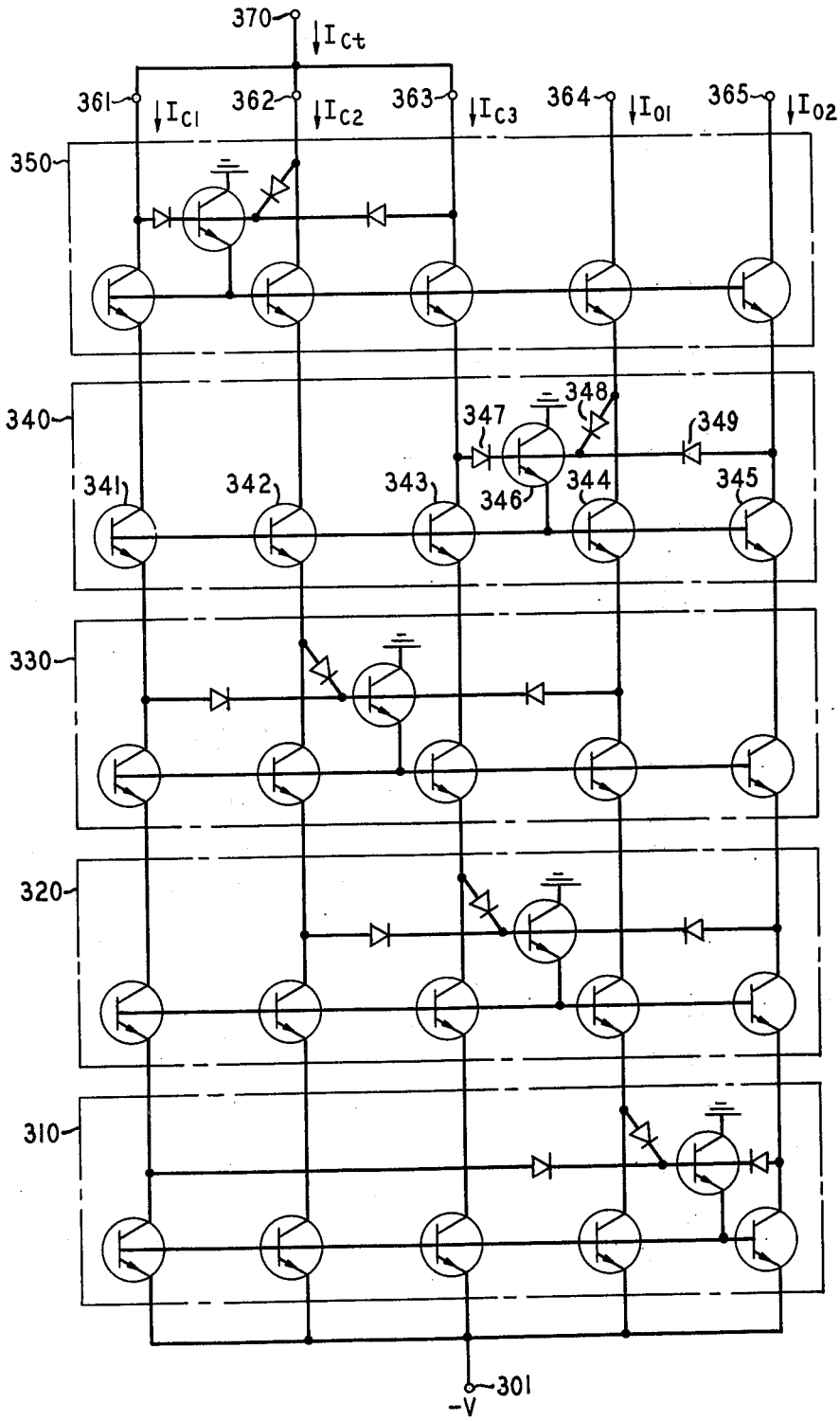
FIG. 5 is a schematic diagram of a current mirror array in which two units of output current are controlled by three units of input current.

FIG. 5 is a schematic representation of a current mirror array wherein unit output currents $I_{01}$ and $I_{02}$ are controlled by unit input currents $I_{c1}$, $I_{c2}$ and $I_{c3}$ which are shown combined in this embodiment by connecting input terminals 361, 362 and 363 to a common input terminal 370 for receiving an overall input control current $I_{ct}$. The currents flowing through the branches of this array can be analyzed to prove that currents $I_{c1}$, $I_{c2}$, $I_{c3}$, $I_{01}$, and $I_{02}$ deviate from each other in proportion to $g^4$, as is the case with the embodiments of FIGS. 1 and 3. Such an analysis of the branch currents of the embodiment is omitted because it would be obvious to persons of ordinary skill in the art in view of the teachings of the specification in the above discussions relating to FIGS. 2 and 4.

The array of FIG. 5 contains five current mirrors 310, 320, 330, 340, and 350 which are connected in a cascode configuration. Referring to current mirror 340 which is structurally and functionally illustrative of the remaining mirrors, controlled NPN transistors 341 to 345 are connected together at their bases. As was the case in the embodiments of FIGS. 1 and 3, the current mirror base drive control means is connected to the collectors of as many controlled transistors as there are input current terminals to the array. Accordingly, the base of NPN base drive control transistor 346 is connected to the collectors of three controlled transistors 343, 344 and 345. Also, diodes 347, 348 and 349 prevent the column currents from combining with each other, as discussed above in connection with the embodiment of FIG. 3.

Figure 6:
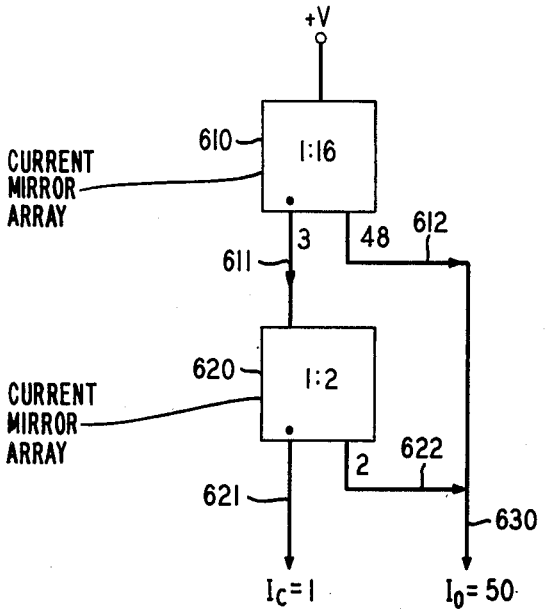
FIG. 6 is a block and schematic representation showing how arrays are cascoded to achieve large current gain ratios.

FIG. 6 is a block representation of two arrays identified as function blocks 610 and 620 which are connected in a parallel/series arrangement for producing an illustrative overall input to output current gain ratio of 1:50. Block 610 is representative of an array illustratively containing 17 current mirrors and 17 columns. Array 610 has one input current terminal 611 and sixteen output current terminals which are connected together to a common output terminal 612 so as to produce an overall current gain ratio of 1:16. For convenience, the array is depicted in the figure as having three units of input current at input terminal 611 for controlling 48 units of output current at common output terminal 612. The input terminals of the arrays are hereinafter identified by a dot.

The input current from input terminal 611 of array 610 is conducted as a supply current to array 620 which provides a current gain ratio of 1:2. This array is illustratively the embodiment of FIG. 1. Three units of input current from array 610 are supplied to array 620 which divides the current to produce one unit of input current at input terminal 621 and two units of output current at common output terminals 622. Currents which escape the columns of the arrays through the bases of the controlled transistors and the control transistors are ignored. Common outputs 612 and 622 are connected together to form overall output 630 which conducts the combined units of current from both arrays to some current utilization means which is not shown. Variations in the control current from input terminal 621 will produce proportional variations in the magnitude of the overall output current at terminal 630. In addition to providing a power saving by controlling fifty units of output current with only one unit of input current, this parallel/series arrangement of arrays produces substantial savings in transistors over a single array with a 1:50 current gain ratio.

Figure 7:
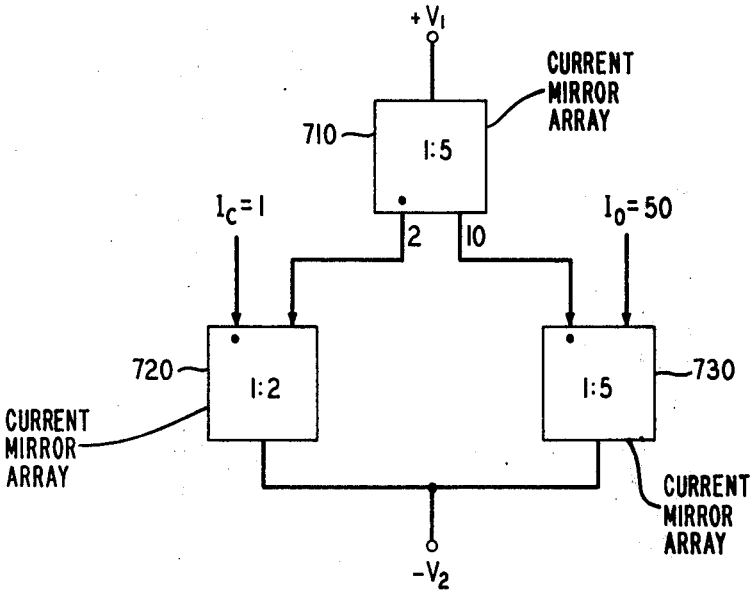
FIG. 7 is a block and schematic representation showing several relatively small arrays connected in a multiply-reflected arrangement to achieve large current gain ratios.

FIG. 7 shows three arrays 710, 720, and 730 which are connected to produce an illustrative overall current gain ratio of 1:50. Array 710 is of the type which employs PNP transistors and produces an illustrative current gain ratio of 1:5. Its two units of input current are conducted to the output terminal of array 720, and its ten units of output current are conducted to the input current terminal of array 730. Arrays 720 and 730 are of the type which employ NPN transistors. Controlling the one unit of input current of array 720 has the effect of controlling the two units of input current from array 710, and consequently the ten units of output current from array 710 which are conducted to the input of array 730, and finally the fifty units of output current of array 730. As was the case in the discussion of FIG. 6, current losses through the bases of the controlled transistors are ignored. Supply voltages +V1 and −V2 are advantageously adjusted by persons of ordinary skill in the art to produce a desired potential at the input and output terminals of the arrays, illustratively virtual ground.

Although the inventive concept disclosed herein has been presented in terms of specific illustrative embodiments, persons of ordinary skill in the art can produce additional embodiments without departing from the spirit and scope of the invention. Accordingly, the specific illustrative embodiments are presented to facilitate comprehension of the invention and should not be construed as a limitation.

I claim:

1. An arrangement including at least first, and second current mirrors each having at least first and second controlled semiconductor devices, each such device having first, second and third terminals, the first terminals of which controlled devices are interconnected, each current mirror having control means connected to the third terminal of the first controlled device for providing current to the first terminals of the controlled devices, which current mirrors are connected in a cascode configuration, the arrangement further comprising, additional current mirrors to total with the first and second current mirrors (m+n), where m and n are nonzero integer values the sum of which is greater than two, each current mirror having additional controlled semiconductor devices to total with the first and second controlled semiconductor devices (m+n), the first terminals of which controlled devices in each current mirror are interconnected, means for connecting the additional current mirrors in a cascode configuration with the first and second current mirrors wherein the third terminal of the controlled devices in each current mirror except the last are each connected to different ones of the second terminals of the controlled devices in a subsequent current mirror to form (m+n) columns of (m+n) series controlled devices, and means connecting the control means of each current mirror to the third terminal of each of m controlled devices thereof, which m control means connections are arranged differently in each current mirror so that each column contains a different set of m third terminals with control means connections for precisely correlating the magnitude of currents in each column in proportion to $g^4$, the m third terminals with control means connections in the last current mirror being input current terminals.

2. The arrangement of claim 1 wherein each controlled semiconductor device is a transistor having base, emitter and collector terminals, which terminals are the first, second and third terminals respectively.

3. The arrangement of claim 1 wherein the control means of each current mirror is a control transistor having an emitter terminal connected to the first terminals of each controlled semiconductor device, a collector terminal connected to a terminal for receiving a reference potential, and a base terminal connected to the third terminal of each of m controlled semiconductor devices in the associated current mirror.

4. An arrangement including at least first, and second current mirrors connected in cascode configuration each having at least first and second controlled semiconductor devices, each such device having first, second and third terminals, the first terminals of which controlled devices are interconnected, each current mirror having a control means connected to the third terminal of the first controlled device for providing current to the first terminals of the controlled devices in an associated current mirror, the arrangement further comprising, additional current mirrors to total with the first and second current mirrors (m+n), where m and n are nonzero integer values the sum of which is greater than two, each current mirror having additional controlled semiconductor devices to total with the first and second controlled devices (m+n), the first terminals of which controlled devices in each current mirror are interconnected, means for connecting the additional current mirrors in a cascode configuration with the first and second current mirrors wherein the third terminal of the controlled semiconductor devices in each current mirror except the last are each connected to different ones of the second terminals of the controlled devices in a subsequent current mirror to form (m+n) columns of (m+n) series controlled devices, the control means of each current mirror being connected to the third terminal of each of m controlled devices thereof, which m control means connections are arranged differently in each current mirror so that each column contains a different set of m third terminals with control means connections, the m third terminals with control means connections in the last current mirror being input current terminals, the control means each including a control transistor having base, emitter and collector terminals, the emitter terminal being connected to the first terminals of each controlled semiconductor device, the collector terminal being connected to a terminal for receiving a reference potential, and a plurality of diodes being connected on a one-to-one basis in circuit between the base terminal of each said control transistor and the third terminal of each of m controlled devices for ensuring equalized distribution of the currents flowing through different columns of the series-connected controlled semiconductor devices.

5. An arrangement for providing output current responsive to at least one input control current in a fixed output to input gain ratio n:m, where n and m are nonzero integer unit values of current the sum of which is greater than two, the arrangement comprising, $(m+n)^2$ controlled devices, each having first, second, and third terminals, arranged in a square array configuration having (m+n) rows, each row having first through (m+n) controlled devices, and (m+n) columns, each column having first through (m+n) controlled devices, means for connecting the first terminal of each controlled device to the first terminal of every other controlled device in the same row, means for connecting the second terminal of each controlled device in the first row to a terminal for receiving an energizing potential, first connecting means for connecting the third terminal of each respective controlled device in every row except the last to an associated one of the second terminals of the controlled devices in the same column and subsequent row so as to connect the (m+n) controlled devices in series in each column, first through (m+n) control devices, each having first, second and third terminals, each control device being associated with a respective one of the rows of controlled devices, each control device having its second terminal connected to the first terminal of each controlled device in the row with which it is associated and the third terminal connected to a terminal for receiving a reference potential, and second connecting means connecting the first terminal of each control device to the third terminal of m controlled devices in the respective row with which the control device is associated in such a connecting scheme throughout the various rows that a different set of third terminals of m controlled devices are so connected in each column for precisely correlating the magnitude of currents in each column in proportion to $g^4$, the m so connected third terminals of the controlled devices in the $(m+n)^{th}$ row being input current terminals to the array.

6. The arrangement of claim 5 wherein each control and controlled device is a transistor having base, emitter and collector terminals, which terminals are the first, second and third terminals respectively.

7. An arrangement for providing output current responsive to at least one input control current in a fixed output to input gain ratio n:m, where n and m are nonzero integer unit values of current the sum of which is greater than two, the arrangement comprising, $(m+n)^2$ controlled transistors, each having base, emitter and collector terminals, arranged in a square array configuration having (m+n) rows, each row having first through (m+n) controlled transistors, and (m+n) columns, each column having first through (m+n) controlled transistors, means for connecting the base terminal of each controlled transistor to the base terminal of every other controlled transistor in the same row, means for connecting the emitter terminal of each controlled transistor in the first row to a terminal for receiving an energizing potential, first connecting means for connecting the collector terminal of each respective controlled transistor in every row except the last to an associated one of the emitter terminals of the controlled transistors in the same column and subsequent row so as to connect the (m+n) controlled transistors in series in each column, first through (m+n) control transistors, each having base, emitter and collector terminals, each control transistor being associated with a respective one of the rows of controlled transistors, each control transistor having its emitter terminal connected to the base terminal of each controlled transistor in the row with which it is associated and the collector terminal connected to a terminal for receiving a reference potential, and second connecting means including diodes for connecting the base terminal of each control transistor to the collector terminal of m controlled transistors in the respective row with which the control transistor is associated to permit normal forward conduction for a given transistor type for ensuring equalized distribution of the currents flowing through the different columns of series-connected controlled transistors, such connections made throughout the various rows connect a different set of collector terminals of m controlled transistors in each column, the m so connected collector terminals of the controlled transistors in the $(m+n)^{th}$ row being input current terminals to the array.

* * * * *